US006178799B1

(12) United States Patent
Miller et al.

(10) Patent No.: US 6,178,799 B1
(45) Date of Patent: Jan. 30, 2001

(54) FORMING PRESS AND METHOD FOR SHAPING ANGLE-SECTION WORKPIECES

(75) Inventors: Richard H. Miller, Rose Hill; Charles E. Buehler; Donald E. Pollard, both of Witchita, all of KS (US)

(73) Assignee: The Boeing Company, Seattle, WA (US)

( * ) Notice: Under 35 U.S.C. 154(b), the term of this patent shall be extended for 0 days.

(21) Appl. No.: 09/416,390

(22) Filed: Oct. 12, 1999

(51) Int. Cl.[7] ..... B21D 7/06

(52) U.S. Cl. ..... 72/315; 72/383; 72/411; 72/379.2

(58) Field of Search ..... 72/411, 315, 314, 72/312, 461, 383, 379.2

(56) References Cited

U.S. PATENT DOCUMENTS

| | | | | |
|---|---|---|---|---|
| 696,784 | * | 4/1902 | Yager | 72/294 |
| 1,921,188 | | 8/1933 | Ireland . | |
| 1,965,716 | * | 7/1934 | Thoms | 72/411 |
| 3,827,278 | | 8/1974 | Mershon et al. | 72/430 |
| 4,276,762 | | 7/1981 | Mershon et al. | 72/316 |
| 4,403,495 | | 9/1983 | Talbot | 72/411 |
| 4,570,474 | | 2/1986 | Tanaka et al. | 72/411 |
| 4,656,858 | | 4/1987 | Addison | 72/181 |
| 4,774,994 | | 10/1988 | Darter et al. . | |
| 5,176,019 | | 1/1993 | Brooks, Jr. | 72/181 |
| 5,253,502 | * | 10/1993 | Poletti | 72/383 |
| 5,642,851 | | 7/1997 | Berthelemy et al. | 72/353.2 |

FOREIGN PATENT DOCUMENTS

| | | | | |
|---|---|---|---|---|
| 59-28406 | * | 7/1984 | (JP) | 72/411 |

* cited by examiner

*Primary Examiner*—Daniel C. Crane
(74) *Attorney, Agent, or Firm*—Alston & Bird LLP

(57) ABSTRACT

A forming press for L-shaped and T-shaped workpieces includes first and second press members relatively movable toward and away from each other along a first direction, a first forming die carried by the first press member for engaging and deforming the workpiece to a desired shape when the press members are moved toward each other with the workpiece held therebetween, and a clamping assembly mounted on the second press member for clamping the leg of the workpiece to stabilize the workpiece during shaping thereof. The clamping assembly comprises at least one cam member fixed with respect to the second press member. The cam member defines a pair of spaced-apart cam surfaces oppositely inclined so as to form a channel that widens in the first direction toward the first press member. The clamping assembly further includes a pair of clamping members disposed within the channel so as to be movable along the first direction. The clamping members define a workpiece-receiving space therebetween for receiving the leg of the workpiece and are in sliding engagement with the cam surfaces such that movement of the clamping members along the first direction away from the first press member causes the clamping members to slide along the cam surfaces and be moved toward each other so as to clamp the leg therebetween. The clamping members are arranged to be urged by the first press member to slide along the cam surfaces toward each other when the press members are moved together. The press also includes an actuator for moving at least one of the press members along the first direction toward the other press member so as to engage and deform the workpiece. Actuation force along only the first direction accomplishes both deformation and clamping of the workpiece by virtue of the clamping arrangement.

21 Claims, 4 Drawing Sheets

FORMING PRESS AND METHOD FOR SHAPING ANGLE-SECTION WORKPIECES

FIELD OF THE INVENTION

The invention relates to forming presses. The invention relates more particularly to a joggling press and associated method for forming joggles in L-shaped or T-shaped workpieces.

BACKGROUND OF THE INVENTION

Joggling is the process of deforming a plate-shaped member by bending the member along two parallel spaced axes through equal and opposite angles. The resulting deformation is referred to as a joggle. Joggles permit flush connections to be made between two plates, sheets, or structural members. In many applications, it is desired to form joggles in L-shaped or T-shaped members having a cap portion that is to be joggled and a leg portion that is joined to the cap portion at an angle. The usual approach to joggling such workpieces involves clamping the leg of the workpiece between two clamping members so that the leg does not wrinkle during the deformation process. In most joggling presses, two actuators are used for moving the clamping members toward each other to clamp the leg, and a third actuator is used to move a forming die along a direction normal to the direction along which the clamping member is moved so that the forming die engages the cap and deforms it to a desired shape.

Conventional joggling presses typically have forming dies that are specifically configured to form only one workpiece configuration. Commonly, two forming dies are bolted to an upper press member and two cooperating forming dies are mounted to the lower press member for engaging and deforming the cap between the two pairs of forming dies. The two lower forming dies comprise clamping members that are movable toward and away from each other. They are typically supported between a pair of fixed blocks immovably bolted to the lower press member. The workpiece is positioned by an operator so that the leg is between the clamping members. The two actuators controlling the clamping members are operated to move the clamping members toward each other to clamp the leg. Once adequate clamping pressure has been applied to the leg, the press members are moved relatively toward each other to cause the cap to be pressed between the two pairs of forming dies carried by the two press members such that the cap is deformed to a shape generally conforming to the shape of forming surfaces of the dies. The press members are then moved back apart, and the clamping pressure on the leg is released. The operator then manually removes the workpiece from the press.

One drawback of such conventional joggling presses is that when a different workpiece configuration is to be produced, the large and heavy forming dies must be unbolted from the press members and removed, and new forming dies must be placed into the press and bolted to the press members. This operation requires considerable time, and is also awkward and cumbersome because of the size and weight of the forming dies, which consist of massive solid metal blocks. A further drawback is that it can be difficult for the operator to locate the workpiece in precisely the correct location with respect to the forming dies. Yet another drawback is the need for two separate actuators for providing the clamping force and the joggling force.

SUMMARY OF THE INVENTION

The present invention seeks to overcome the above drawbacks by providing a press and method for deforming angle-section workpieces wherein a single actuator producing force along a single direction generates both the force for deforming the workpiece and the force for clamping the workpiece, by virtue of a unique arrangement of tooling members. Thus, only one actuator is required, thereby simplifying the press and providing attendant cost benefits. Additionally, in preferred embodiments of the invention, the tooling includes forming die inserts mounted to the press by quick-release fastening systems. The forming die inserts are significantly less massive than conventional forming dies, and can be removed and installed without the use of bolts or similar fasteners. Thus, the time required for changing the forming die inserts is substantially less than that required to change conventional forming dies. The process of changing the forming die inserts is also more convenient and less cumbersome than changing conventional forming dies because the inserts are substantially smaller and lighter in weight than conventional dies. The forming die inserts are also less costly than conventional forming dies.

In other preferred embodiments of the invention, a workpiece is precisely located with respect to the forming dies by a locator that is positioned within the workpiece-receiving space defined between a pair of clamping members that clamp the leg of the workpiece to prevent its wrinkling during a forming process. The leg of the workpiece is slid along the workpiece-receiving space until it abuts the locator, thereby locating the workpiece in the proper location with respect to the tooling. Advantageously, after the forming operation is completed, the locator is withdrawn from the workpiece-receiving space so that the workpiece can be slid out a discharge end of the space. Preferably, the press is arranged so that gravity alone will cause the workpiece to slide out the discharge end when the locator is withdrawn. Thus, the operator need not manually remove the workpiece from the press. The locator can be actuated automatically by a suitable actuator such as an air cylinder or solenoid so as to be extended into the workpiece-receiving space prior to a workpiece being fed into the infeed end of the workpiece-receiving space, and to be withdrawn from the space after completion of the forming operation on the workpiece.

A press in accordance with one preferred embodiment of the invention comprises first and second press members relatively movable toward and away from each other along a first direction, a first forming die carried by the first press member for engaging and deforming the workpiece to a desired shape when the press members are moved toward each other with the workpiece held therebetween, and a clamping assembly mounted on the second press member for clamping the leg of the workpiece to stabilize the workpiece during shaping thereof. The clamping assembly comprises at least one cam member fixed with respect to the second press member. The cam member defines a pair of spaced-apart cam surfaces oppositely inclined so as to form a channel that widens in the first direction toward the first press member. The clamping assembly further includes a pair of clamping members disposed within the channel so as to be movable along the first direction. The clamping members define a workpiece-receiving space therebetween for receiving the leg of the workpiece and are in sliding engagement with the cam surfaces such that movement of the clamping members along the first direction away from the first press member causes the clamping members to slide along the cam surfaces and be moved toward each other so as to clamp the leg therebetween. The clamping members are arranged to be urged by the first press member to slide along the cam surfaces toward each other when the press members are moved together. The press also includes an actuator for moving at least one of the press members along the first direction toward the other press member so as to engage and deform the workpiece. Actuation force along only the first direction accomplishes both deformation and clamping of the workpiece by virtue of the clamping arrangement.

Preferably, each clamping member comprises a main body member and a forming die insert secured to the main body member by a quick-release fastening system, the forming die inserts being configured to receive and clamp the leg of the workpiece therebetween. The main body members remain in the press permanently, and only the forming die inserts are removed and replaced when a tooling change is required. The quick-release fastening systems advantageously comprise keys and keyways formed on the main body members and forming die inserts. Accordingly, the inserts can be slid out and removed and a new set of inserts can be slid into place in the main body members in a short amount of time, since no bolts or similar fasteners are required.

The forming die on the first press member advantageously is also readily removable and replaceable with the aid of a quick-release fastening system. In a preferred embodiment, the forming die is secured between a pair of guides that are affixed to a die shoe or press plate of the first press member. Advantageously, keys and keyways are formed between the guides and the forming die so that the forming die can be slid out and a new forming die can be slid into place between the guides.

The press advantageously also includes a locator selectively movable between a locating position and a discharge position. The locator in the locating position intrudes into the workpiece-receiving space such the workpiece abuts the locator for locating the workpiece in a desired location for a forming operation. After the forming operation is completed, the locator is withdrawn from the workpiece-receiving space to allow the workpiece to be discharged from the press. The press preferably is arranged on an incline so that gravity causes the workpiece to slide out a discharge end of the workpiece-receiving space when the locator is withdrawn.

The invention also encompasses a method for deforming an angle-section workpiece enabling the workpiece to be precisely located with respect to the tooling and to be automatically discharged from the tooling after a forming operation. The method in accordance with a preferred embodiment of the invention includes providing a pair of tooling members defining a workpiece-receiving space therebetween with the space being inclined relative to horizontal such that the workpiece will slide under the influence of gravity along the tooling members with the leg disposed in the space. A locating device is positioned in the workpiece-receiving space. The method further includes feeding the workpiece into an infeed end of the workpiece-receiving space until the leg abuts the locating device such that the workpiece is located in a desired position for a forming operation, urging a forming die against the cap of the workpiece with the cap supported on forming surfaces of the tooling members so as to deform the workpiece to a desired shape, withdrawing the locating device from the workpiece-receiving space following deforming of the workpiece, and allowing gravity to cause the deformed workpiece to slide out a discharge end of the workpiece-receiving space.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
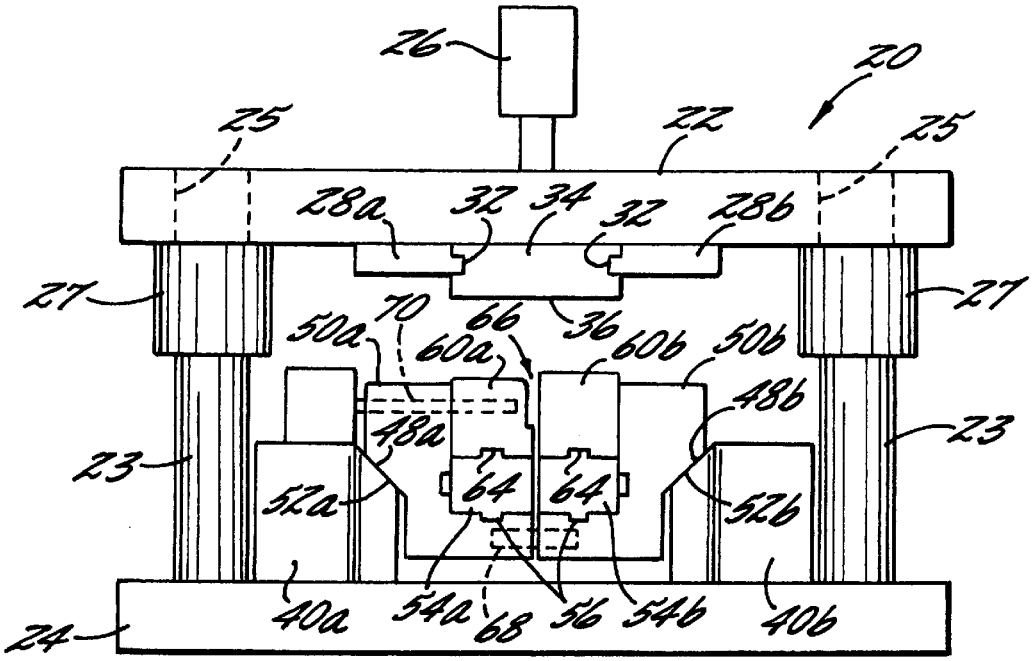
FIG. 1 is a front elevation of a tooling assembly in accordance with a preferred embodiment of the invention mounted to a pair of press members, showing the press members in a withdrawn position allowing a workpiece to be inserted between the tooling.
Figure 2:
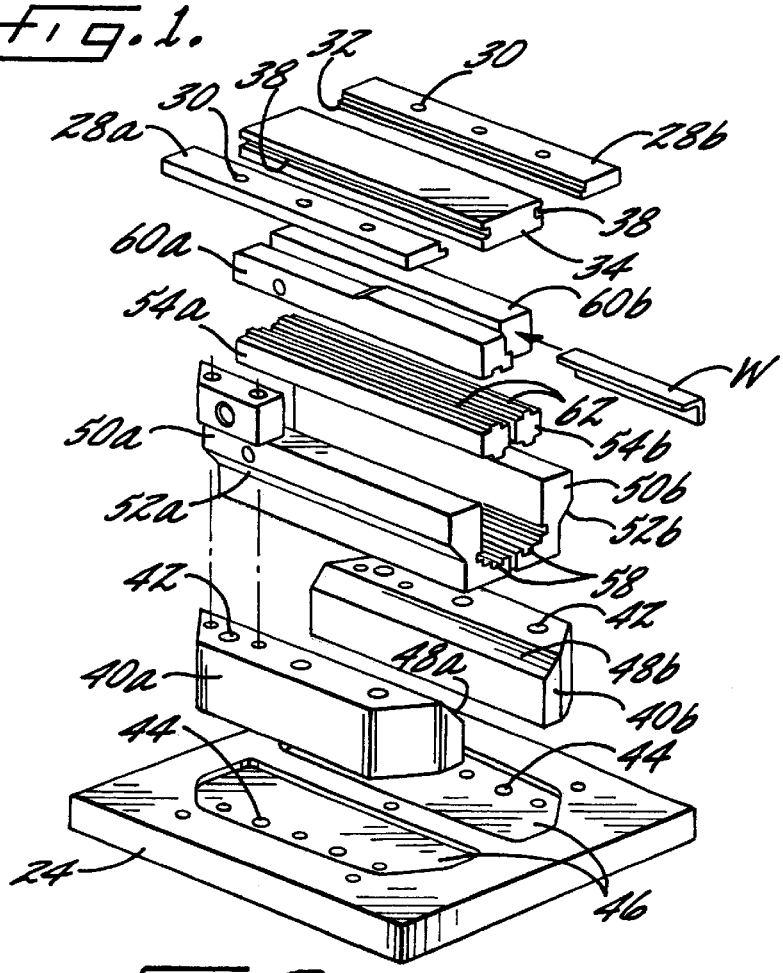
FIG. 2 is an exploded perspective view of the tooling assembly of FIG. 1.
Figure 3:
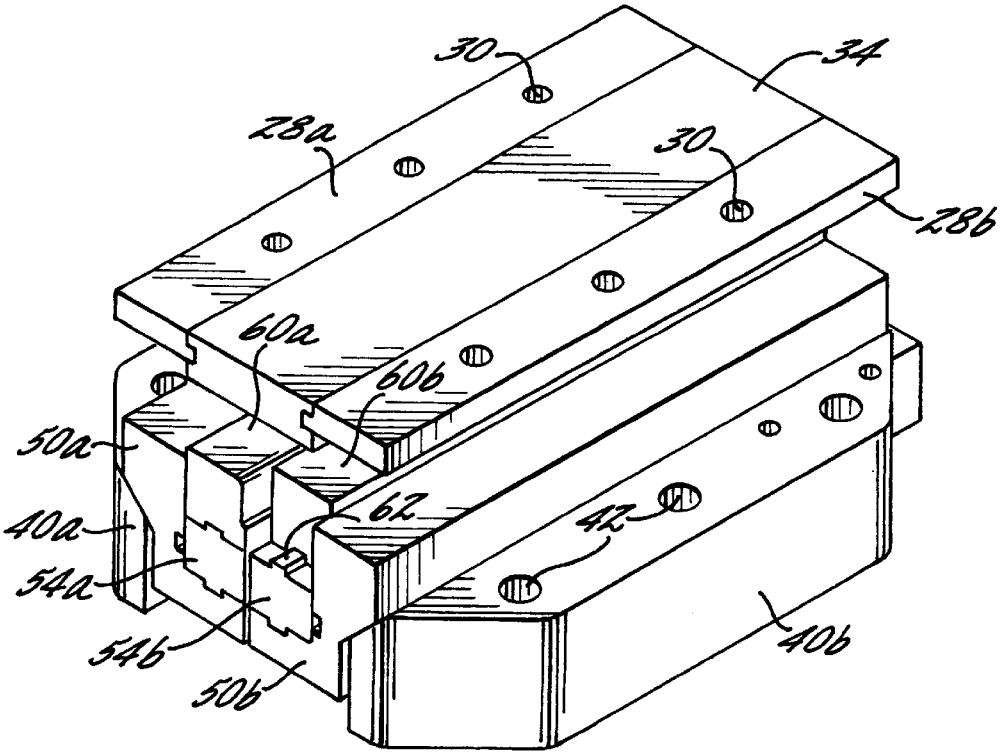
FIG. 3 is a perspective view of the tooling assembly of FIG. 2 in an assembled condition.

With reference to FIGS. 1–3, a press 20 in accordance with a first embodiment of the invention is depicted. The press 20 includes a first press member in the form of an upper die shoe 22, and a second press member in the form of a lower die shoe 24. The die shoes comprise thick metal plates capable of withstanding the forces sustained during deformation of a workpiece without substantially deflecting. Generally, one of the die shoes is stationary, while the other die shoe is reciprocatingly movable toward and away from the stationary die shoe. In the embodiment of the invention shown in FIGS. 1–3, the upper die shoe 22 is the movable member and the lower die shoe 24 is the stationary member. However, it will be recognized that alternatively, the upper die shoe could be stationary while the lower die shoe is movable, or both die shoes could be movable toward and away from each other. The upper die shoe 22 is connected to a suitable actuator 26 that is operable to move the shoe 22 toward the lower die shoe 24 for performing a forming operation on a workpiece, and to retract the upper die shoe 22 away from the lower die shoe 24 at the completion of the forming operation. In FIG. 1, the upper die shoe 22 is shown in the retracted position. Advantageously, guide columns 23 are affixed to the lower die shoe 24, and the upper die shoe 22 defines apertures 25 through which the guide columns extend for preventing tilting of the upper die shoe as it reciprocates. Guide collars 27 affixed to the upper die shoe 22 receive the guide columns 23 and further aid in guiding the movement of the upper die shoe.

Figure 4:
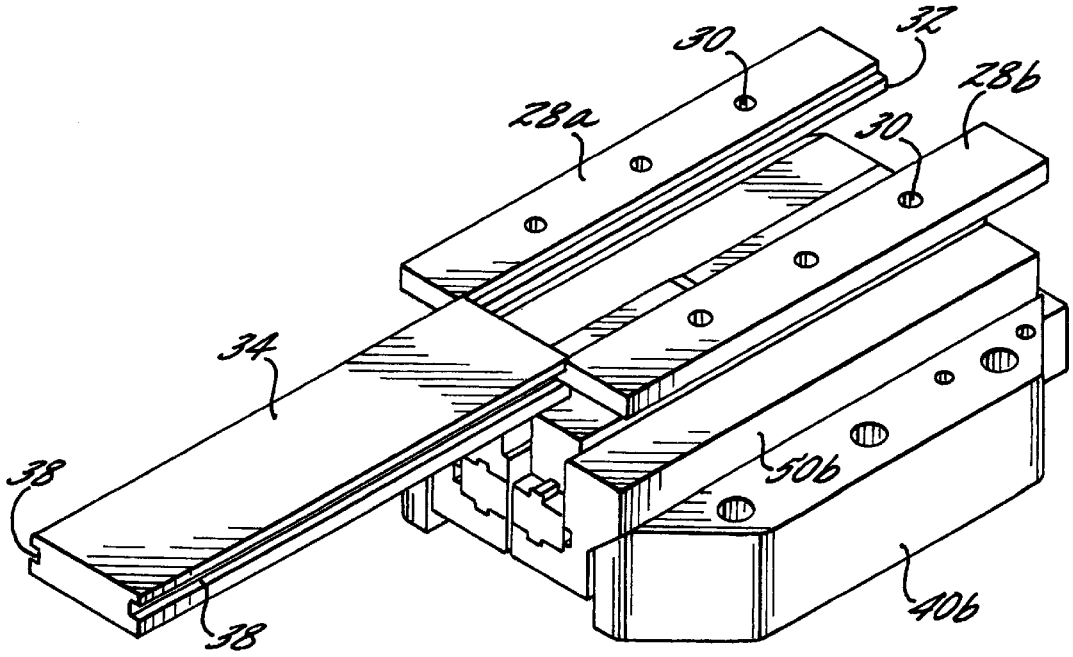
FIG. 4 is a view similar to FIG. 3, showing the forming die on the upper press member having been partially removed from the guides that are affixed to the upper press member.
Figure 5:
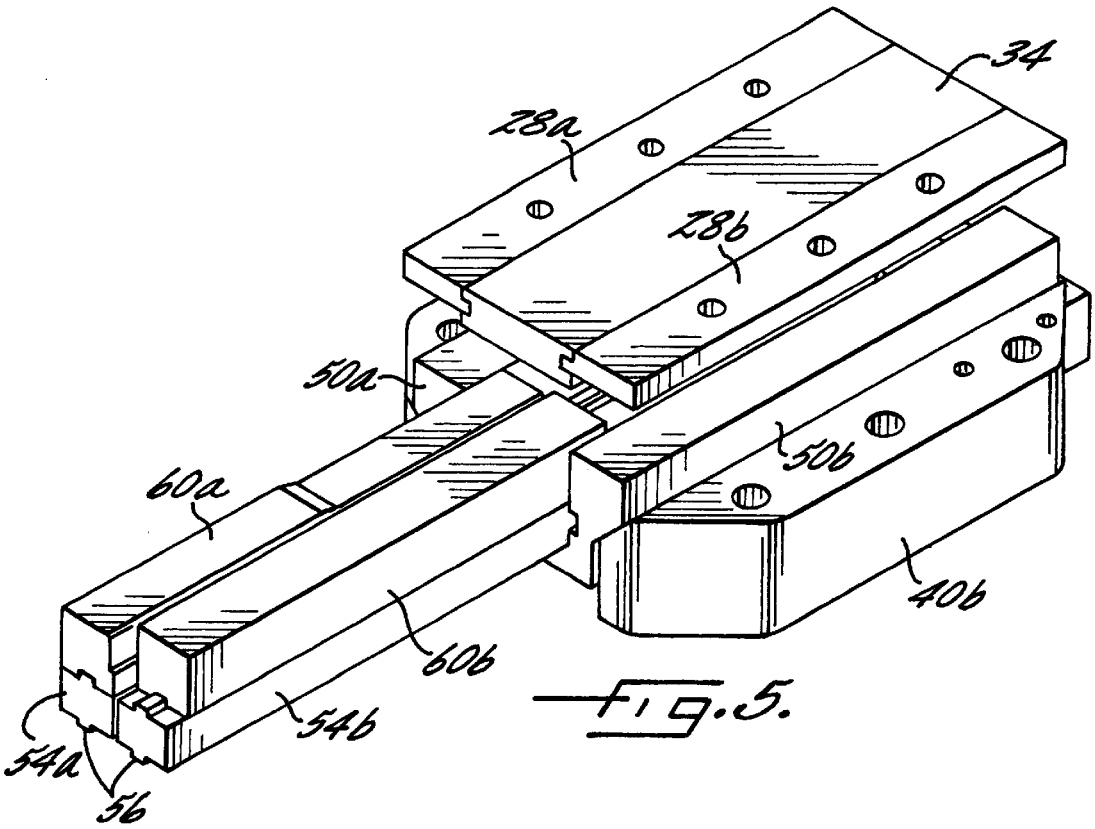
FIG. 5 is a view similar to FIG. 3, showing the spacers and forming die inserts on the lower press member having been partially removed from the main body members of the tooling assembly.
Figure 6:
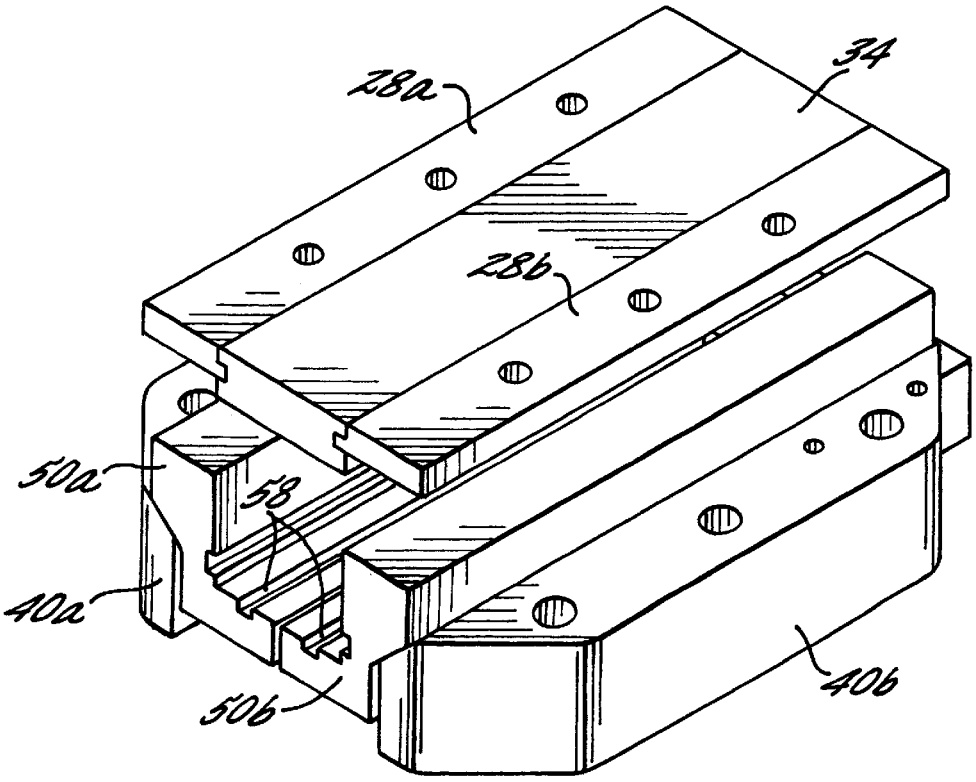
FIG. 6 is a view similar to FIG. 5, with the spacers and forming die inserts completely removed from the main body members.

The upper die shoe 22 has affixed to it a pair of guides 28*a* and 28*b* comprising generally plate-shaped metal members. The guides 28*a,b* are advantageously affixed to the upper die shoe 22 by fasteners (not shown) such as bolts or screws passed through holes 30 in the guides and into corresponding holes (not shown) in the upper die shoe. The guides 28*a,b* are spaced apart and define opposing surfaces that face each other. Projecting from these opposing surfaces are keys 32 that extend longitudinally (in a front-to-back direction of the press) along the guides. The upper die shoe 22 also supports a forming die 34 whose lower surface 36 is configured to have a contour that is desired to be imparted to a workpiece W. The forming die 34 has opposite longitudinal side edge surfaces in which are formed keyways 38 configured to slidably accept the keys 32 formed on the guides 28*a,b*. Accordingly, the forming die 34 is secured to the upper die shoe 22 by sliding the forming die between the guides 28*a,b* such that the keys 32 ride in the keyways 38. FIG. 3 shows the forming die 34 in the installed position. FIG. 4 shows the forming die 34 having been slid out from between the guides.

The lower die shoe 24 supports an arrangement of tooling members that act cooperatively with the forming die 34 on the upper die shoe so as to deform the workpiece W when the upper die shoe 22 is urged toward the lower die shoe 24, and that also act to clamp the leg of the workpiece to prevent wrinkling of the leg during the forming process. This arrangement of tooling members includes a pair of cam blocks 40*a* and 40*b* that are affixed to the lower die shoe 24 by suitable fasteners (not shown) such as bolts or screws passed through holes 42 in the cam blocks and into corresponding holes 44 in the lower die shoe. Advantageously, the lower die shoe includes a recessed area 46 within which each of the cam blocks 40*a,b* sits. The recesses 46 provide additional stability to the cam blocks, beyond that provided by the fasteners that affix the cam blocks to the lower die shoe, in response to shear forces exerted on them in directions parallel to the upper surface of the lower die shoe. The cam blocks 40*a* and 40*b* define oppositely inclined cam surfaces 48*a* and 48*b*, respectively, that generally face toward each other and collectively define a generally V-shaped channel between them that widens in the direction from the lower die shoe toward the upper die shoe.

The tooling arrangement on the lower die shoe further includes a pair of main body members 50*a* and 50*b* that are movably disposed between the cam blocks 48*a,b*. The main body members 50*a* and 50*b* include inclined surfaces 52*a* and 52*b*, respectively, that are parallel to and in sliding engagement with the cam surfaces 48*a* and 48*b* of the cam blocks. The main body members 50*a,b* are generally L-shaped in cross section and include portions that extend generally horizontally toward each other in the space between the two cam blocks 40*a,b*. A small gap exists between these horizontal portions in the side-to-side direction of the press. These horizontal portions of the main body members 50*a* and 50*b* support a pair of spacers 54*a* and 54*b*, respectively. The spacers include keys 56 formed on their lower surfaces, and the main body members 50*a,b* include corresponding keyways 58 such that the spacers are secured to the main body members by sliding the spacers onto the main body members. Accordingly, the spacers 54*a,b* are affixed to the main body members but can readily be removed and replaced without having to use bolts or similar types of fasteners.

The tooling arrangement on the lower die shoe also includes a pair of forming die inserts 60*a* and 60*b* respectively secured to the spacers 54*a* and 54*b* by keys 62 formed on the upper surfaces of the spacers and corresponding keyways 64 formed in the lower surfaces of the forming die inserts. The forming die inserts 60*a,b* are spaced apart by a small gap in the side-to-side direction, and a portion of this gap defines a workpiece-receiving space 66 for receiving the leg of a workpiece W. The workpiece-receiving space 66 advantageously has a constant cross section along its length and is open at both opposite ends of the forming die inserts; thus, the workpiece W can be slid into the space 66 from one end of the forming die inserts. The space 66 preferably is slightly wider than the thickness of the leg of the workpiece so that the workpiece can freely slide along the space prior to and after completion of a forming operation. During a forming operation, however, the forming die inserts 60*a,b* preferably are urged toward each other to narrow the workpiece-receiving space 66 and to clamp the leg of the workpiece between the inserts.

Figure 7:
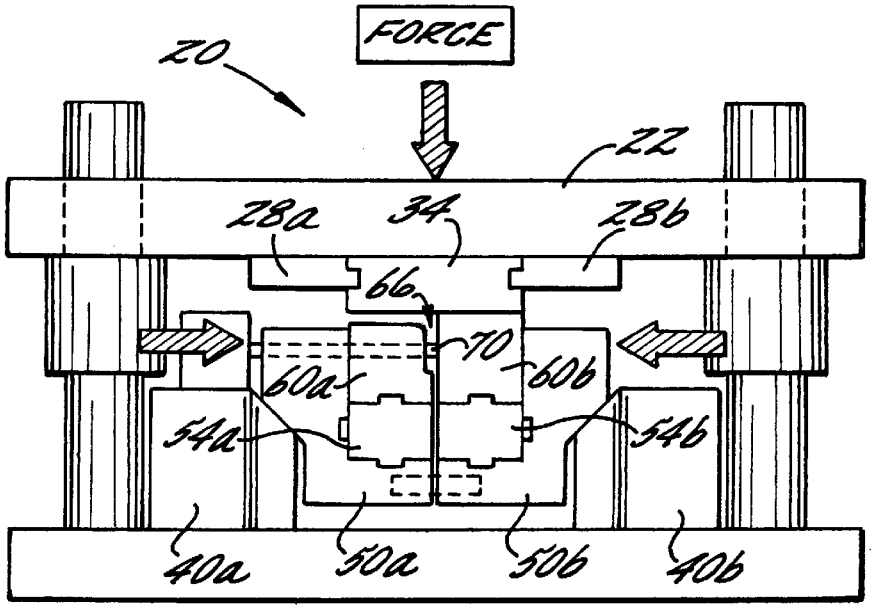
FIG. 7 is a view similar to FIG. 1, but showing the upper press member having been moved toward the lower press member for deforming a workpiece, and illustrating how the main body members slide down the cam surfaces of the cam blocks in response to the force exerted on them by the forming die carried by the upper press member.

This clamping action of the forming die inserts 60*a,b* is a unique feature of the invention. The clamping action occurs by virtue of the cam surfaces 48*a,b* and the main body members 50*a,b* that are free to slide upward and downward along these cam surfaces. Advantageously, one or more spring devices 68 are connected between the main body members 50*a* and 50*b*. The spring devices 68 bias the main body members away from each other in the side-to-side direction so that when the upper die shoe 22 is in the retracted position as shown in FIG. 1, the main body members are urged apart so as to slide upward and outward along the cam surfaces 48*a,b,* and hence the width of the workpiece-receiving space 66 is wider than the thickness of the workpiece leg, thus allowing the workpiece to freely slide along the space. When the press actuator 26 is activated to cause the upper die shoe 22 to move toward the lower die shoe 24 and bring the upper forming die 34 into engagement with the workpiece supported on the forming die inserts 60*a,b,* however, the downward force exerted by the upper forming die 34 on the forming die inserts 60*a,b* causes the main body members 50*a,b* to slide inward and downward along the cam surfaces 48*a,b*. This causes the forming die inserts 60*a,b* to be moved toward each other to narrow the workpiece-receiving space 66 and clamp against the leg of the workpiece, as depicted in FIG. 7. Thus, with only the single force applied to the upper die shoe 22, both deformation of the workpiece and clamping of the workpiece are accomplished.

A further aspect of the invention involves locating the workpiece within the workpiece-receiving space 66 in the proper location with respect to the forming die inserts 60*a,b,* and discharging the workpiece from the press following a forming operation. To these ends, the press 20 includes a locator 70 comprising a pin or the like, which is movable between a locating position and a discharge position. In the locating position, the locator 70 intrudes into the workpiece-receiving space 66 so that the workpiece abuts the locator 70 when it is slid into the space prior to beginning a forming operation. FIG. 7 shows the locator 70 positioned in the locating position. In the discharge position, as shown in FIG. 1, the locator 70 is withdrawn from the space 66. The locator 70 preferably is located near a rear end of the space 66 so that the workpiece can be slid into the space from a front side of the press until the workpiece leg abuts the locator. The operator then knows that the workpiece is in the proper position with respect to the tooling. The locator 70 advantageously extends through a hole formed through the forming die insert 60*a* and through a hole formed through the main body member 50*a*. An end of the locator remote from the workpiece-receiving space 66 is connected to a suitable actuator such as an air cylinder or solenoid (not shown). This actuator operates to extend the locator 70 prior to a workpiece being loaded into the press, and to retract the locator 70 after a forming operation on the workpiece has been completed.

For automatic discharging of the workpiece from the press 20 after the forming operation has been completed, the press 20 advantageously is arranged on an incline so that the die shoes 22 and 24 slope downwardly from their front edges toward their rear edges along the lengthwise direction of the workpiece-receiving space 66. Accordingly, when the forming operation is completed, the upper die shoe 22 is retracted and the locator 70 is withdrawn to its discharge position as shown in FIG. 1. The removal of the force on the forming die inserts 60*a,b* allows the spring device 68 between the main body members 50*a,b* to urge the main body members apart, thereby moving the forming die inserts 60*a,b* apart from each other so as to release their grip on the workpiece. Advantageously, a blast of air from a nozzle or the like (not shown) is used to unseat the workpiece from the forming die inserts 60*a,b,* and the workpiece then slides under the influence of gravity toward the rear end of the press and exits the workpiece-receiving space 66. The completed workpiece can be discharged onto a conveyor for transporting the workpiece to a further work station.

Figure 8:
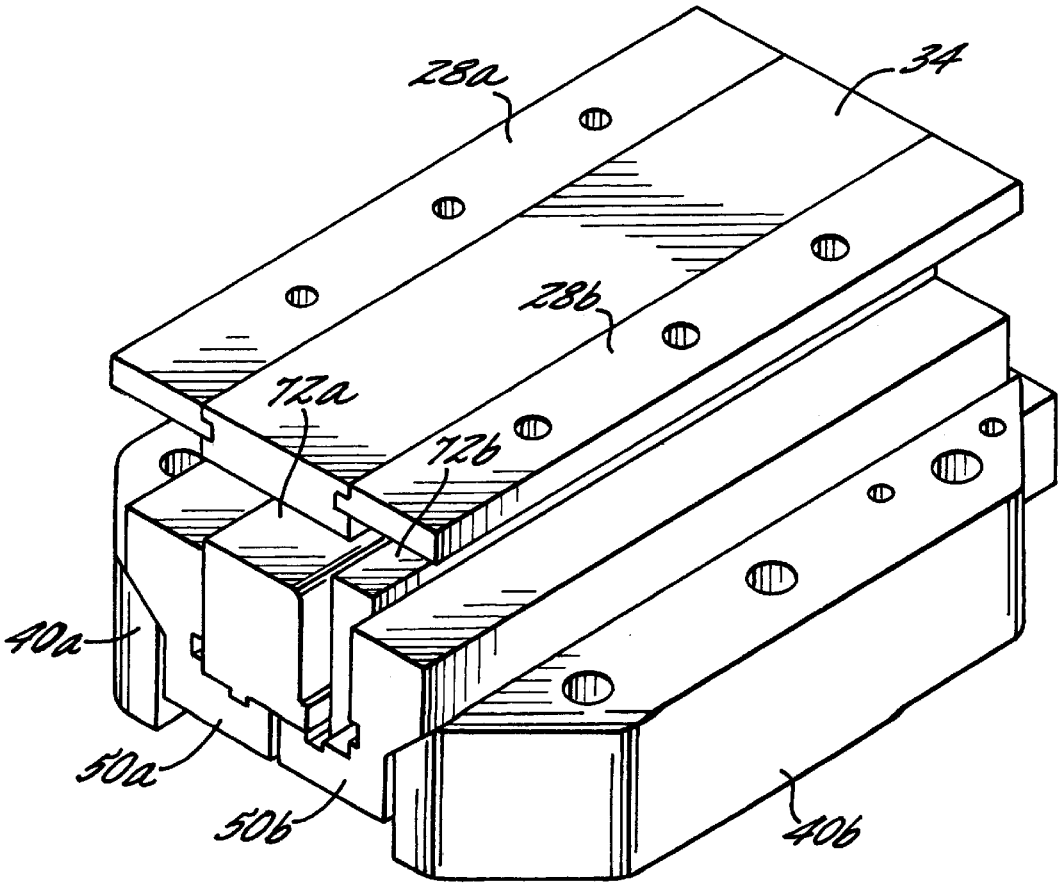
FIG. 8 is a view similar to FIG. 3, showing an alternative embodiment of the invention in which the spacers have been removed and taller forming die inserts have been installed in the main body members.

Many different workpiece configurations can be formed in the press 20 by installing suitably configured forming dies 34 and forming die inserts 60*a,b*. Where the leg of the workpiece is longer than can be accommodated between the forming die inserts 60*a,b,* the spacers 54*a,b* can be removed and a set of forming die inserts 72*a,b* of increased height can be installed into the main body members 50*a,b,* as shown in FIG. 8. The dies and inserts, and spacers if needed, are readily and quickly removable and replaceable by virtue of the quick-release fastening systems in the form of cooperating keys and keyways as described above. It will be recognized, of course, that keys and keyways are only one illustrative type of quick-release fastening system that can be used within the scope of the invention, and other types of quick-release fastening systems can be used instead, including cam locks, spring-loaded pins, and others known in the art.

Many modifications and other embodiments of the invention will come to mind to one skilled in the art to which this invention pertains having the benefit of the teachings presented in the foregoing descriptions and the associated drawings. For example, although two separate cam blocks 40*a,b* are described for defining the cam surfaces along which the main body members slide, it will be recognized that alternatively a single integral structure could be used for this purpose. Furthermore, while it is considered advantageous to make the forming die inserts and spacers removable from the main body members, the forming die inserts and spacers alternatively could be made as integral portions of the main body members without sacrificing the advantages of the invention with respect to the clamping action of the forming die inserts, the locating of the workpiece by virtue of the locator 70, and the discharging of the workpiece from the press by gravity. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A press for shaping an angle-section workpiece having a cap and a leg joined at an angle to each other, the press comprising:

first and second press members relatively movable toward and away from each other along a first direction;

a first forming die carried by the first press member for engaging and deforming the workpiece to a desired shape when the press members are moved toward each other with the workpiece held therebetween;

a clamping assembly mounted on the second press member for clamping the leg of the workpiece to stabilize the workpiece during shaping thereof, the clamping assembly comprising:

at least one cam member fixed with respect to the second press member, the cam member defining a pair of spaced-apart cam surfaces oppositely inclined so as to form a channel that widens in said first direction toward the first press member; and a pair of clamping members disposed within said channel so as to be movable along said first direction, the clamping members defining a workpiece-receiving space therebetween for receiving the leg of the workpiece and being in sliding engagement with the cam surfaces such that movement of the clamping members along said first direction away from the first press member causes the clamping members to slide along the cam surfaces and be moved toward each other so as to clamp the leg therebetween, the clamping members being arranged to be urged by the first press member to slide along the cam surfaces toward each other when the press members are moved together; and an actuator for moving at least one of the press members along said first direction toward the other press member so as to engage and deform the workpiece, whereby actuation force along only said first direction accomplishes both deformation and clamping of the workpiece.

2. The press of claim 1, wherein each clamping member comprises a main body member and a forming die insert secured to the main body member by a quick-release fastening system, the forming die inserts being configured to receive and clamp the leg of the workpiece therebetween.

3. The press of claim 2, wherein the quick-release fastening systems comprise keys and keyways formed on the main body members and forming die inserts.

4. The press of claim 2, further comprising a spacer disposed between each forming die insert and the respective main body member, the forming die insert being secured to the spacer by a quick-release fastening system.

5. The press of claim 1, wherein the cam member comprises a pair of cam blocks each defining one of the cam surfaces.

6. The press of claim 1, further comprising a locator selectively movable between a locating position and a discharge position, the locator in the locating position intruding into the workpiece-receiving space such the workpiece abuts the locator for locating the workpiece in a desired location, the locator in the discharge position being withdrawn from the workpiece-receiving space.

7. The press of claim 6, wherein the clamping members are arranged such that the leg of the workpiece can be slid lengthwise into the workpiece-receiving space from an infeed end of the clamping members until the leg abuts the locator.

8. The press of claim 7, wherein the press is arranged on an incline such that gravity causes the workpiece to slide along the workpiece-receiving space, and wherein the clamping members are biased apart by a spring device such that when the press members are moved apart, the clamping members are urged away from each other so as to release their grip on the workpiece.

9. The press of claim 8, further comprising an actuator connected with the locator and operable to move the locator into the discharge position following completion of an operation on the workpiece such that gravity causes the workpiece to slide out a discharge end of the workpiece-receiving space.

10. The press of claim 1, wherein the first forming die on the first press member is secured to the first press member by a quick-release fastening system.

11. The press of claim 10, wherein the quick-release fastening system comprises keys and keyways formed in the first press member and the first forming die.

12. The press of claim 11, wherein the first press member comprises a first press plate and a pair of guides affixed thereto, the keys and keyways being formed between the guides and the first forming die such that the first forming guide can be slid into position between the guides.

13. A tooling assembly for a forming press of the type having a pair of press members relatively movable toward and away from each other, the tooling assembly being adapted to deform an angle-section workpiece having a cap and a leg joined at an angle to each other, and comprising:

at least one cam member adapted to be affixed to one of the press members, the cam member defining a pair of spaced-apart oppositely inclined cam surfaces that face generally toward each other;

a pair of clamping members defining a workpiece-receiving space therebetween for receiving the leg of the workpiece, the clamping members being disposed between the cam surfaces in sliding engagement therewith such that sliding of the clamping members in one direction along the cam surfaces causes the clamping members to move toward each other so as to narrow the workpiece-receiving space and sliding of the clamping members in an opposite direction along the cam surfaces causes the clamping members to move away from each other so as to widen the workpiece-receiving space, the clamping members defining forming surfaces facing generally toward the other press member for engaging one side of the cap of the workpiece; and a forming die assembly adapted to be mounted on the other press member for engaging an opposite side of the cap and for urging the cap against the clamping members so as to deform the workpiece to a desired shape and to cause the clamping members to slide along the cam surfaces and clamp the leg of the workpiece therebetween.

14. The tooling assembly of claim 13, wherein each clamping member comprises a main body member and a forming die insert secured to the main body member by a quick-release fastening system, the forming die inserts being configured to receive and clamp the leg of the workpiece therebetween.

15. The tooling assembly of claim 14, wherein the quick-release fastening systems comprise keys and keyways formed on the main body members and forming die inserts.

16. The tooling assembly of claim 14, further comprising a spacer disposed between each forming die insert and the respective main body member, the forming die insert being secured to the spacer by a quick-release fastening system.

17. The tooling assembly of claim 16, wherein keys and keyways are formed between the main body members and the spacers to permit quick assembly and disassembly of the spacers with the main body members.

18. The tooling assembly of claim 16, wherein the quick-release fastening systems securing the forming die inserts to the spacers comprise keys and keyways formed between the forming die inserts and the spacers.

19. The tooling assembly of claim 13, wherein the forming die assembly comprises a pair of guides adapted to be affixed to the other press member, and a forming die secured to the guides by quick-release fastening systems.

20. The tooling assembly of claim 19, wherein the quick-release fastening systems for securing the forming die to the guides comprise keys and keyways formed between the guides and the forming die.

21. A method for deforming an angle-section workpiece having a cap and a leg joined at an angle to each other so as to form a joggle in the cap, the method comprising:

providing a pair of tooling members defining a workpiece-receiving space therebetween with the space being inclined relative to horizontal such that the workpiece will slide under the influence of gravity along the tooling members with the leg disposed in the space;

positioning a locating device in the workpiece-receiving space;

feeding the workpiece into an infeed end of the workpiece-receiving space until the leg abuts the locating device such that the workpiece is located in a desired position for a forming operation;

urging a forming die against the cap of the workpiece with the cap supported on forming surfaces of the tooling members so as to form a joggle in the cap;

supporting the tooling members on oppositely inclined surfaces such that force exerted by the forming die on the tooling members causes the tooling members to be urged along the inclined surfaces toward each other so as to clamp the leg of the workpiece therebetween;

withdrawing the locating device from the workpiece-receiving space following deforming of the workpiece; and allowing gravity to cause the deformed workpiece to slide out a discharge end of the workpiece-receiving space.

* * * * *